US009230757B2

(12) United States Patent
Rego et al.

(10) Patent No.: US 9,230,757 B2
(45) Date of Patent: Jan. 5, 2016

(54) SWITCH GUARD FOR RESTRICTING THE OPERATION OF A ROCKER TYPE ELECTRIC WALL SWITCH

(71) Applicant: American Tack & Hardware, Co. Inc., Saddle River, NJ (US)

(72) Inventors: Daniel T. Rego, Dallas, TX (US); Adam Greenspan, Dallas, TX (US); Daren Moneta, Dallas, TX (US); Edward Hunt, Dallas, TX (US)

(73) Assignee: AMERICAN TACK & HARDWARE CO., INC., Saddler River, NJ (US)

( * ) Notice: Subject to any disclaimer, the term of this patent is extended or adjusted under 35 U.S.C. 154(b) by 228 days.

(21) Appl. No.: 13/846,479

(22) Filed: Mar. 18, 2013

(65) Prior Publication Data

US 2014/0262710 A1 Sep. 18, 2014

(51) Int. Cl.

| | |
|---|---|
| ***H01H 23/04*** | (2006.01) |
| ***H01H 9/28*** | (2006.01) |
| *H01H 9/02* | (2006.01) |

(52) U.S. Cl.

CPC ..... *H01H 23/04* (2013.01); *H01H 9/287* (2013.01); *H01H 2009/0292* (2013.01)

(58) Field of Classification Search

CPC ..... H01H 23/02; H01H 23/04; H01H 9/287

USPC ..... 200/43.11–43.22, 50.01–50.04, 294, 200/315–322, 329; 174/53–58, 60, 61, 63, 174/66, 67

See application file for complete search history.

(56) References Cited

U.S. PATENT DOCUMENTS

| | | | | |
|---|---|---|---|---|
| 1,445,847 | A | | 2/1923 | Platt |
| 4,102,471 | A | | 7/1978 | Lore |
| 4,363,944 | A | | 12/1982 | Poirier |
| 4,506,120 | A | * | 3/1985 | Fleischman ..... 200/43.19 |
| 4,876,425 | A | | 10/1989 | Woskow |
| 4,920,243 | A | | 4/1990 | Yuge |
| D314,556 | S | | 2/1991 | Aggson |
| D351,376 | S | | 10/1994 | Hughes |

(Continued)

FOREIGN PATENT DOCUMENTS

JP 9-274837 A 10/1997

OTHER PUBLICATIONS

English Abstract for JP 9-274837 A.

(Continued)

*Primary Examiner* — Amy Cohen Johnson
*Assistant Examiner* — Marina Fishman
(74) *Attorney, Agent, or Firm* — Hedman & Costigan, P.C.; James V. Costigan; Kathleen A. Costigan

(57) ABSTRACT

An electrical rocker wall switch guard that is sized to fit over an electrical rocker wall switch where the electrical rocker wall switch guard has a main body sized to fit over a rocker arm of an electrical rocker wall switch; at least one aperture; and a circumferential skirt that extends downwardly from the main body and extends completely around the main body, the circumferential skirt having integrally formed portions at a first end and a second end of the electrical rocker wall switch guard that provide an attachment structure that permits removable attachment of the electrical rocker wall switch guard to an electrical rocker wall switch using screw receiving fittings that are provided in the electrical rocker wall switch for a decorative or protective wall plate.

8 Claims, 4 Drawing Sheets

(56) References Cited

U.S. PATENT DOCUMENTS

| | | | | | |
|---|---|---|---|---|---|
| 5,385,417 | A | | 1/1995 | Wade | |
| D360,876 | S | | 8/1995 | Hughes | |
| 5,468,925 | A | | 11/1995 | Mohsen | |
| 5,486,660 | A | * | 1/1996 | Fasano | 200/43.16 |
| 5,558,209 | A | * | 9/1996 | Mohsen | 200/43.22 |
| 5,723,833 | A | * | 3/1998 | Thrasher | 200/50.12 |
| 5,738,206 | A | | 4/1998 | Souza | |
| 5,794,759 | A | * | 8/1998 | Butts | 200/43.19 |
| 5,934,451 | A | | 8/1999 | Yu | |
| D440,949 | S | | 4/2001 | Hadley | |
| D507,476 | S | | 7/2005 | Zahedi et al. | |
| D514,922 | S | | 2/2006 | Zahedi et al. | |
| 7,214,898 | B1 | | 5/2007 | Margareten | |
| D583,205 | S | | 12/2008 | Waliszewski | |
| D707,639 | S | | 6/2014 | Rego | |

OTHER PUBLICATIONS

English Abstract for JP 5-347113 A.

* cited by examiner

SWITCH GUARD FOR RESTRICTING THE OPERATION OF A ROCKER TYPE ELECTRIC WALL SWITCH

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1) Field of the Invention

This invention relates to a switch guard for restricting the operation of a rocker type electric wall switch.

2) Description of Related Art

The problem of the inadvertent operation of an electric wall switch and the resulting problems caused by connecting or disconnecting domestic electrical circuits is well known.

In the prior art, the typical method of preventing the inadvertent operation of an electric wall switch has been to apply a strip of adhesive tape that would prevent the operation of the electric switch and would also serve as a reminder that the particular switch was to remain in a preset condition.

In U.S. Pat. No. 5,486,660, a guard is disclosed for use with a circuit breaker switch that would only allow the circuit to be turned on with a finger and would not allow the circuit to be turned off except with the aid of a specially designed tool. U.S. Pat. No. 4,506,120 discloses a switch guard that that is positioned on top of a conventional toggle type electric wall switch so that the toggle switch may not be operated. U.S. Pat. No. 5,794,759 discloses a flat protective cover for a rocker switch that is attached to the rocker switch using hook and loop fasteners that are widely available as Velcro® fasteners. The protective cover has two holes positioned over one arm of the rocker switch and two holes over the other arm of the rocker switch. An implement or tool is used to operate the rocker arm switch once the cover is fastened in place with the hook and loop fasteners.

SUMMARY OF THE INVENTION

The present invention provides an electrical rocker wall switch guard that is sized to fit over an electrical rocker wall switch where said switch guard has at least one aperture to allow operating access to a rocker arm of said electrical rocker wall switch. The electrical rocker wall switch guard comprises a main body 10 sized to fit over said rocker arm and a circumferential skirt that extends downwardly from said main body and extends completely around the main body of the wall guard. The top surface of the main body is also the top surface of the switch guard. The circumferential skirt has integrally formed portions at opposite sides, namely at a first end and a second end of said switch guard that provide an attachment structure that permits removable attachment of said electrical rocker wall switch guard to an electrical rocker wall switch using screw receiving fittings that are provided in said electrical rocker wall switch for a decorative wall plate.

The invention also includes a kit comprising the electrical rocker wall switch guard and two screws that are adapted to fit the holes provided for a decorative wall plate of an electrical rocker wall switch where said screws have a length that is sufficient to permit the mounting of the electrical rocker wall switch guard of the invention on said electrical rocker wall switch.

It is a first object of the invention to provide a removable switch guard for an electrical rocker wall switch that may be removably positioned over an electrical rocker wall switch so as to prevent operation of the switch by inadvertent contact with a person or a moving object.

It is also an object of the invention to provide a removable guard for an electrical rocker wall switch that may be removably positioned over an electrical rocker wall switch so as to prevent operation of the switch by using a hand or finger while allowing operation by using a tool.

It is also an object of this invention to provide a removable guard for an electrical rocker wall switch that may be installed using simple tools without the need to drill holes or use any type of an adhesive fastening system.

It is also an object of the invention to provide a removable guard for an electrical rocker wall switch that may be operated without any special tool other than a suitably sized rigid object.

It is also an object of the invention to provide a removable guard for an electrical rocker wall switch that is made of transparent material so that the operating portions of the electrical rocker wall switch may be viewed when the switch guard is in place.

It is also an object of the invention to provide a significant improvement over the prior art switch guards which have either prevented all access to a rocker switch or have required a specialized tool or complete removal of the switch guard in order to operate the rocker switch.

It is also an object of this invention to provide a switch guard for an electrical rocker wall switch that may be installed over a rocker switch without regard to assigning a top or bottom to the switch guard and without regard to the position of the rocker arm of the electrical rocker wall switch.

These and other objects and advantages of the invention will be readily apparent in view of the following description and drawings of the above-described invention.

DETAILED DESCRIPTION OF THE INVENTION

Figure 1:
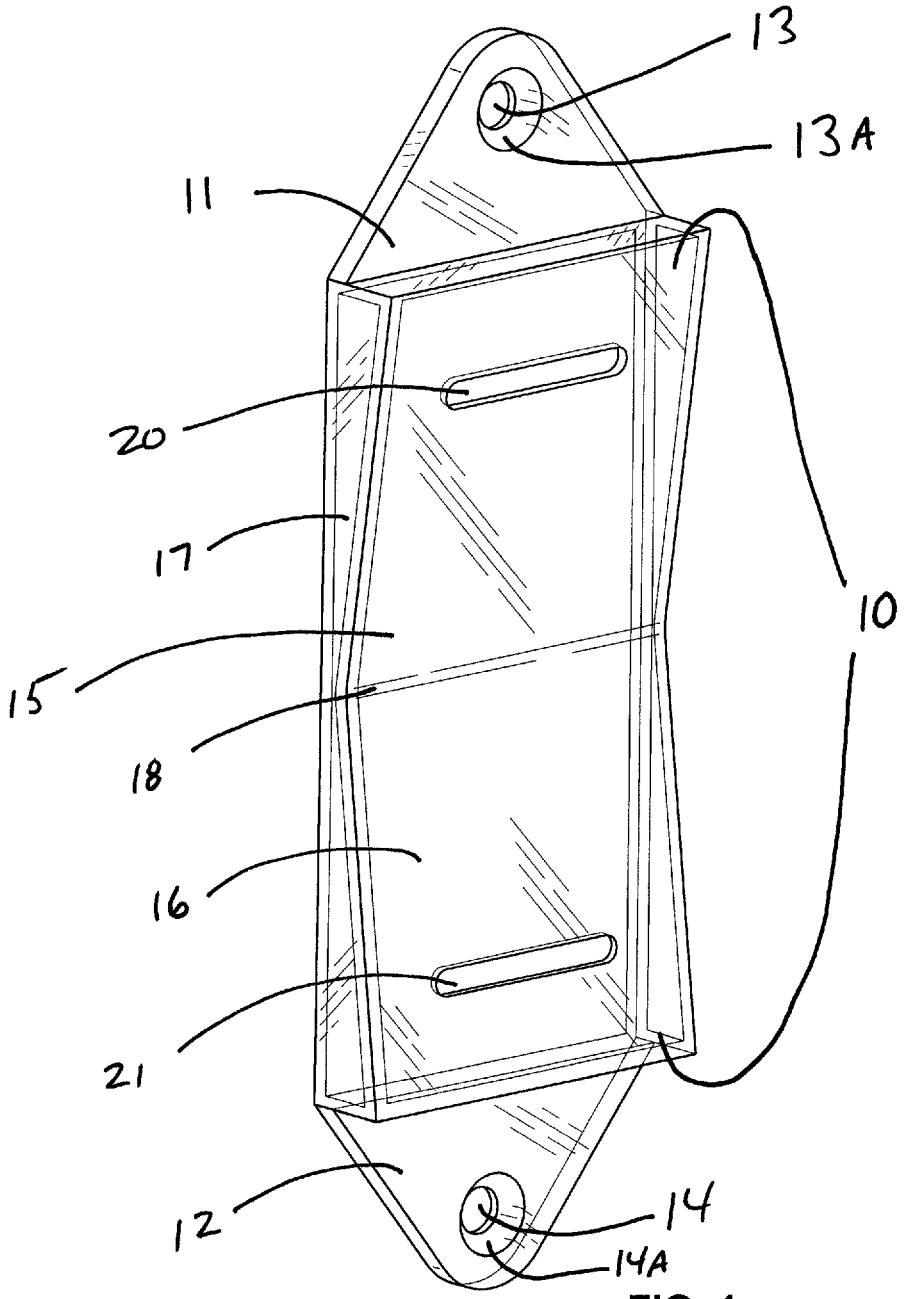
FIG. 1 is a front perspective view of a switch guard according to the invention where the switch guard is made of transparent material.

A preferred embodiment of the present invention provides an electrical rocker wall switch guard comprising a main body 10 and a circumferential skirt 17 having integrally formed flange portions 11,12 at a first end and a second end to permit removable attachment of the switch guard to an electrical rocker wall switch using the same screw receiving fittings that are provided in an electrical rocker wall switch for a decorative wall plate. In a preferred embodiment the switch guard is sized to fit over an operating arm of an electrical rocker wall switch so that it does not contact the operating arm of the electrical rocker wall switch and in this preferred embodiment of the invention, said main body 10 has a top surface consisting of two angled portions 15,16 connected by a mid section 18. In an alternative embodiment the switch guard may contact the operating arm of an electrical rocker wall switch in such a manner that it does not interfere with the operation of the switch. Circumferential skirt 17 is attached to the main body and extends downwardly from said main body and extends completely around the main body 10 of the switch guard.

It is preferred that the switch guard be shaped in the form of a rectangle that generally follows the profile of a rocker arm that is typically provided in an electrical rocker wall switch. Other polygonal shapes that may be utilized include triangular, quadrilateral, hexagonal, or pentagonal shapes and the like as well as circular, oval or square shapes. It is preferred that the switch guard be sized so that it does not extend beyond the perimeter of a protective or decorative wall plate that is typically affixed to an electrical rocker wall switch but the invention is not limited to any particular size as long as it provides the protective function of preventing inadvertent operation of the rocker arm wall switch.

The switch guard is adapted for removable attachment to an installed electrical rocker wall switch for preventing unintentional operation of the switch and/or operation of the switch by young children or others for reason of safety or for other reasons.

In a preferred embodiment the two angled portions of the switch guard are sized to fit over the top angled surfaces of the rocker arm that operates an electrical rocker wall switch and the switch guard has two flanged portions 11,12 at a first end and a second end of the circumferential skirt. The switch guard has two screw holes 13,14 in register with the holes in an electrical rocker arm switch that are provided for a decorative wall plate and two apertures in said main body of said switch guard to permit access to the top angled surfaces of the rocker arm of the electrical rocker wall switch.

The switch guard of the invention is preferably provided as a transparent structure as shown in FIGS. 1-8 so that the position of the rocker arm may be viewed with the switch guard in place. The switch guard may be made from transparent thermoplastics such as crystal polystyrene or it may be made from an opaque material for use in an environment where it would not be necessary to view the position of the rocker switch or for aesthetic reasons. Depending on the environment of use, engineering thermoplastics such as polycarbonates may be used for the fabrication of the switch guard or wood or metal may also be used to make the switch guard of the invention. Generally, the thickness of various elements of the switch guard will be from about 2-5 mm.

As best seen in FIG. 1, a preferred embodiment of the switch guard has a main body 10 that is substantially rectangular in shape with a first triangular extended flange 11 at a first end of the switch guard and a corresponding second triangular extended flange 12 at a second end of the switch guard. Each of the triangular extended flanges 11 and 12 is provided with a hole. Flange 11 is provided with a first hole 13 and flange 12 is provided with a second hole 14 that are positioned to be in register with the standard threaded holes that are provided in the top and bottom sections of an electrical rocker wall switch housing (See FIG. 8). The first and second holes 13 and 14 are shown with chamfered edges 13A and 14A to accommodate a standard screw that is adapted for fastening a decorative or protective wall plate to an electrical rocker wall switch housing. If the triangular extended flanges 11, 12 are too thick to be accommodated by a standard length decorative wall plate screw, a screw having a proper length may be utilized. The length should be sufficient to accommodate the added thickness of the switch guard of the invention which would require a screw having a length of about 10-20 mm. The switch guard is preferably sized so that the edges of the switch guard do not extend beyond the perimeter of the customary protective or decorative wall plate that is placed over the rocker switch. It is contemplated that the switch guard will be installed over the customary protective or decorative wall plate that is conventionally installed on an electrical rocker wall switch.

Figure 8:
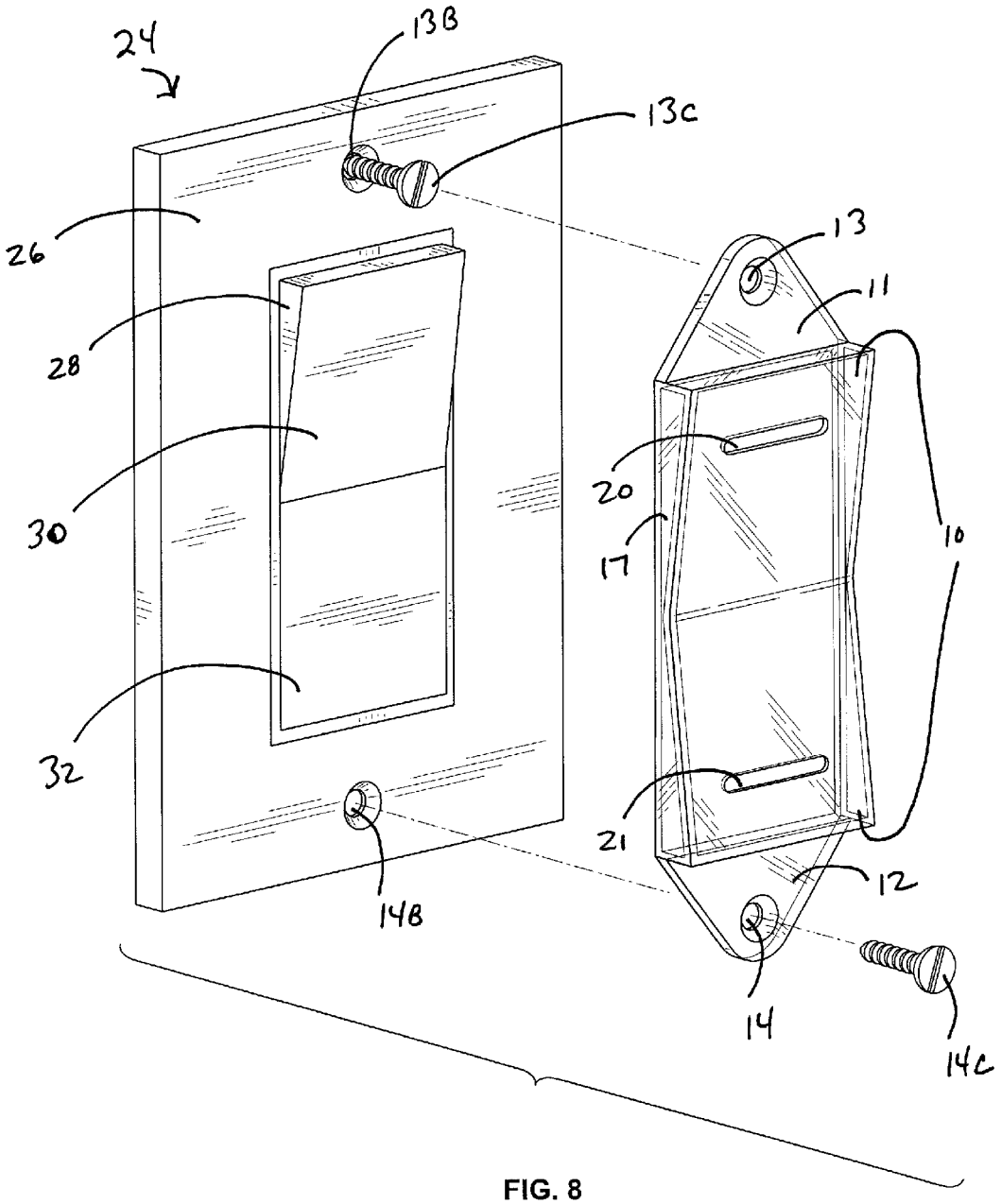
FIG. 8 is a perspective view of a standard rocker wall switch showing the manner in which the switch guard is positioned over the rocker arm of the rocker wall switch.

FIG. 8 shows a perspective exploded view of an electrical rocker wall switch 24 which is a standard item of electrical hardware with a switch guard according to the invention where the switch guard is positioned away from the electrical rocker wall switch. The broken lines show the manner in which the switch guard is installed over the rocker arm using the threaded screw receiving fittings 13B, 14B that are provided in the electrical rocker wall switch for the installation of a decorative or protective cover using screws. These electrical rocker wall switches have a face plate 26 and a rocker arm 28. The rocker arm 28 is designed so that when it is in an open or closed position, a first face 30 is elevated from the face plate 26 and a second face 32 is substantially coplanar with the face plate 26. When the rocker arm is operated by depressing the elevated part (e.g. first face 30) of the rocker arm, the elevated face 30 of the rocker arm 28 is depressed to be coplanar with the face plate 26. Depending on the vertical orientation of the rocker switch, moving the rocker arm opens or closes the electrical circuit.

The switch guard will have an aperture that is located so that a rigid article may be passed through the aperture so that the rigid article may be used to apply sufficient pressure on the rocker arm 28 so that the rocker arm will operatively open or close the electrical circuit controlled by the electrical rocker wall switch. The aperture may be located in the top surface of the main body 10 in the side of the main body 10 or in a location on the circumferential skirt 17 that will permit the insertion of a rigid object that may be manipulated to cause the rocker arm to change position. In a preferred embodiment, a first aperture 20 and a second aperture 21 will be provided in the top surface of the main body 10.

The shape of each of the apertures is not critical and the aperture may have a generally circular, oval (elliptical), rectangular (slot), star or diamond shape. Other shapes may also be utilized as the shape of the aperture is not critical. The aperture must be large enough to allow a rigid article to pass for the purpose of operating a rocker arm of an electrical rocker wall switch when the switch guard is positioned over an electrical rocker wall switch. The aperture must be small enough so that a human finger may not pass through the aperture in order to prevent accidental or deliberate operation of the switch without some type of a rigid article. Generally the diameter of a circular opening will be 2 mm to 6 mm and preferably from 1.5 mm to 5 mm; a rectangular or slot shaped opening will be from 1.5 to 20 mm wide and preferably from 2 to 20 mm in length; an oval or elliptical shaped opening will have as it minor diameter 2 mm to 8 mm, preferably 1.5 mm to 20 mm and as its major diameter 2 mm to 20 mm, preferably from 4 mm to 8 mm. Irregular shaped openings will be sized to achieve the functional results described above. The preferred opening will be rectangular as this shape provides the most secure method of preventing access to a rocker arm by a person having small fingers.

Figure 2:
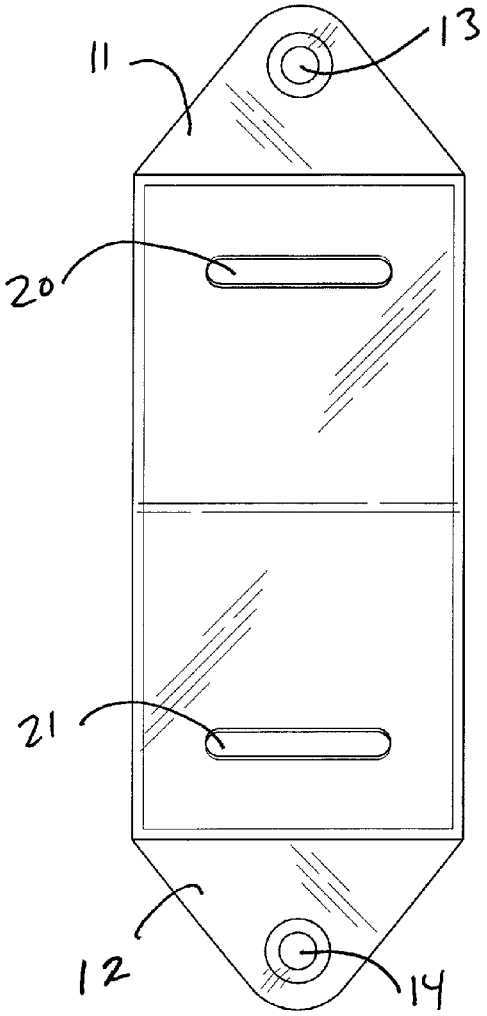
FIG. 2 is a front view of the switch guard of FIG. 1.
Figure 3:
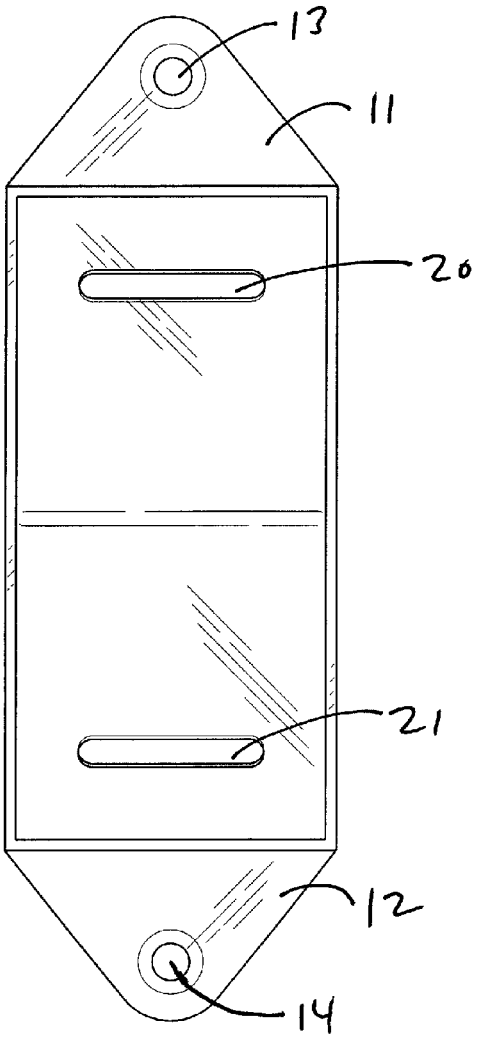
FIG. 3 is a back view of the switch guard of FIG. 1.
Figure 4:
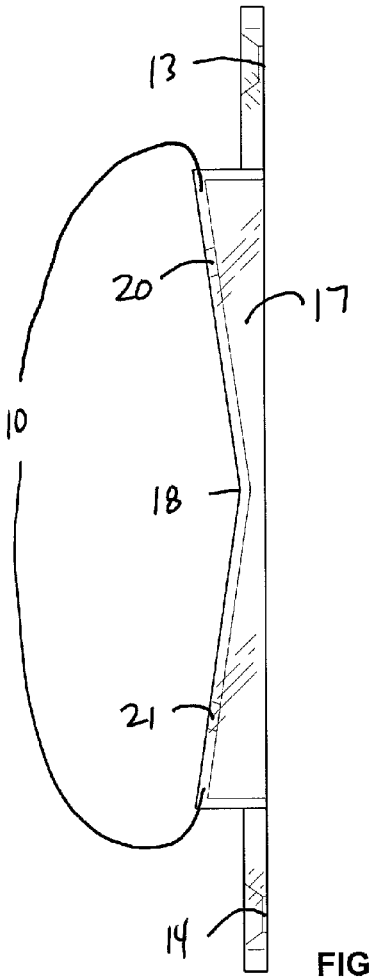
FIG. 4 is a left side view of the switch guard of FIG. 1.
Figure 5:
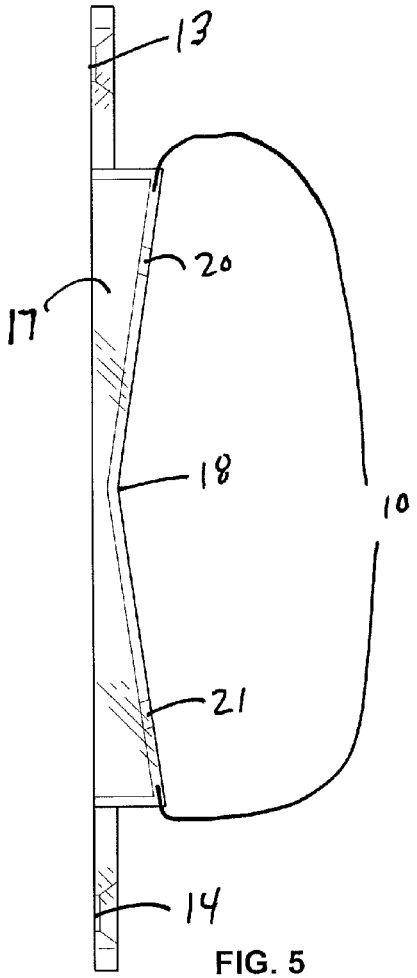
FIG. 5 is right side view of the switch guard of FIG. 1.
Figure 6:
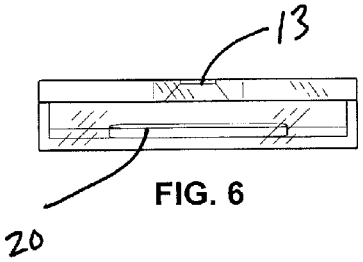
FIG. 6 is a top view of the switch guard of FIG. 1.
Figure 7:
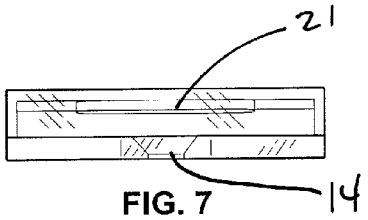
FIG. 7 is a bottom view of the switch guard of FIG. 1.

The rigid article may be an elongated wooden, metal or plastic pin, disc or rod shaped article that is sized to pass through the aperture of the switch guard and will have sufficient rigidity that it will be capable of operatively engaging a rocker arm so that the rigid article that will pass through the aperture of the switch guard and transmit to the rocker arm a force that is sufficient to operatively open or close the electrical circuit controlled by the rocker arm. The pin, disc or rod may have a circular, oval, square or rectangular profile and will have a sufficient length so that it can be gripped by a persons fingers when it is passed through the aperture of the switch guard for the purpose of operatively engaging the rocker arm. Generally the rigid article will have a cross-sectional dimension of about 2-10 mm and a length of 30 mm to 100 mm. Generally rectangularly shaped slots 20,21 are shown in FIG. 2 as a preferred embodiment of an aperture because it will accept common household articles such as a coin, eating utensil or paperclip when it is desired to operate the rocker arm of the electrical rocker wall switch.

The switch guard is shaped so that the main body 20 and circumferential skirt 17 will provide a housing that will accommodate the rocker arm of an electrical rocker wall switch as shown in FIG. 8. This design will accommodate the rocker arm whether the rocker arm is in the open or closed position.

While the invention has been illustrated by various preferred ways of carrying out the invention, the invention is not limited to the disclosed embodiments.

The invention claimed is:

1. An electrical rocker wall switch guard that is sized to fit over an electrical rocker wall switch where said electrical rocker wall switch guard comprises:

a main body sized to fit over a rocker arm of an electrical rocker wall switch;

at least one aperture;

and a circumferential skirt that extends downwardly from said main body and extends completely around said main body, said circumferential skirt having integrally formed portions at a first end and a second end of said electrical rocker wall switch guard that provide an attachment structure that permits removable attachment of said electrical rocker wall switch guard to an electrical rocker wall switch using screw receiving fittings that are provided in said electrical rocker wall switch for a decorative or protective wall plate wherein said main body consists of two angled portions, angled upwardly from a mid-section; triangularly shaped portions are integrally formed at the first end and the second end; and wherein said main body of the electrical rocker wall switch guard is sized to fit over the top angled surfaces of a rocker arm of said electrical rocker wall switch such that the electrical rocker wall switch guard does not prevent the operation of said rocker arm of said electrical rocker wall switch.

2. The electrical rocker wall switch guard as defined in claim 1 wherein two apertures are provided in said main body of said electrical rocker wall switch guard to permit access to angled surfaces of a rocker arm with an article that is smaller than a human finger to allow said article to be placed in operative contact with said rocker arm of said electrical rocker wall switch.

3. The electrical rocker wall switch guard as defined in claim 1 wherein the aperture is rectangularly shaped.

4. The electrical rocker wall switch guard according to claim 1 wherein said housing is made of transparent plastic.

5. The electrical rocker wall switch guard according to claim 1 wherein said housing is made of opaque plastic.

6. The electrical rocker wall switch guard according to claim 1 wherein said housing is made of wood.

7. The electrical rocker wall switch guard according to claim 1 wherein said housing is made of metal.

8. A kit for an electrical rocker wall switch guard for an electrical rocker wall switch where said kit comprises the electrical rocker wall switch guard of claim 1 and two screws adapted to fit the standard holes provided for a decorative or protective plate where said screws have a length of from 10-20 mm.

* * * * *